United States Patent [19]

Talucci

[11] 4,147,303

[45] Apr. 3, 1979

[54] HEAT-SAVING SMOKE PIPE ATTACHMENT

[76] Inventor: Anthony Talucci, 2045 Valley Dr., Syracuse, N.Y. 13207

[21] Appl. No.: 862,433

[22] Filed: Dec. 20, 1977

Related U.S. Application Data

[63] Continuation-in-part of Ser. No. 792,226, Apr. 29, 1977, abandoned.

[51] Int. Cl.[2] ..... F24B 7/04

[52] U.S. Cl. ..... 237/55; 165/DIG. 2; 126/110 R; 126/99 P; 126/99 D

[58] Field of Search ..... 237/51, 53, 55; 126/99 P, 110 R, 99 C, 99 D, 121; 122/20 B; 165/DIG. 2; 138/38; 236/DIG. 9, 11, 46 E

[56] References Cited

U.S. PATENT DOCUMENTS

| | | | |
|---|---|---|---|
| 5,871 | 5/1874 | Twitchell | 126/99 P |
| 1,026,777 | 5/1912 | Swett | 126/99 P |
| 2,013,136 | 9/1935 | Cornelius | 236/11 |
| 2,266,563 | 12/1941 | McCorkle | 236/11 |
| 2,343,542 | 3/1944 | Faunce | 165/DIG. 2 |
| 2,362,940 | 11/1944 | Skerritt | 126/110 R |
| 2,468,909 | 5/1949 | Yeager et al. | 237/55 |
| 2,619,022 | 11/1952 | Hergenrother | 237/55 |
| 2,677,394 | 5/1954 | Brinen et al. | 138/38 |
| 2,704,062 | 3/1955 | Beyerman | 126/110 R |
| 2,808,494 | 10/1957 | Telkes | 126/110 R |
| 3,124,197 | 3/1964 | Funk | 165/DIG. 2 |
| 3,813,039 | 5/1974 | Wells | 237/55 |
| 4,037,582 | 7/1977 | Moody | 126/110 R |
| 4,044,950 | 8/1977 | Engeling et al. | 237/55 |
| 4,050,627 | 9/1977 | Mayer | 237/55 |
| 4,050,628 | 9/1977 | Konnerth | 237/55 |
| 4,103,826 | 8/1978 | Wass | 237/55 |

*Primary Examiner*—Henry C. Yuen
*Attorney, Agent, or Firm*—Charles S. McGuire

[57] ABSTRACT

A heat-saving attachment in the nature of a jacket surrounding the smoke pipe of a furnace located in a basement or other relatively unheated space. Air is drawn from the unheated space or other area into the annular space between the jacket and smoke pipe, absorbing heat from the exterior of the pipe as it is directed through laterally disposed baffle means within the annular space from whence it is directed through a warm air duct to a space to be heated. Electrical controls may be provided to establish predetermined time delays between turning on and off of the furnace burner and respective on and off controls of an intake fan for drawing air from the unheated space into the jacket.

3 Claims, 8 Drawing Figures

HEAT-SAVING SMOKE PIPE ATTACHMENT

REFERENCE TO RELATED APPLICATION

The present application is a continuation-in-part of U.S. application Ser. No. 792,226, filed Apr. 29, 1977, now abandoned of the same inventor.

BACKGROUND OF THE INVENTION

The present invention relates to means for improving heating efficiency of domestic space heating systems and, more specifically, to attachments for furnace smoke pipes located in relatively unheated spaces.

Heating systems for many homes and other buildings include a furnace located in a basement, utility room or other such location which is relatively unheated compared to the rooms or other spaces to which heat is supplied by the heating system. A smoke pipe of galvanized sheet metal, or the like, extends from the combustion chamber of the furnace to a chimney or outside vent opening. During periods of furnace operation the smoke pipe exterior can become quite hot from the products of combustion passing therethrough. Since the smoke pipe is generally located within the relatively unheated space, the heat radiating therefrom is, for all practical purposes, wasted.

It is a principal object of the present invention to provide a heat-saving attachment which recovers a significant portion of the heat radiating from a smoke pipe located in a relatively unheated space for delivery to a relatively heated space.

It is a further object to provide a simple and inexpensive heat-saving attachment which may be quickly and conveniently incorporated in existing domestic heating systems.

Another object is to provide a heat-saving attachment for recovering otherwise wasted heat from a furnace smoke pipe in an efficient manner by providing electrical controls for forced air circulation means which are timed to operate in predetermined relationship to operation of the furnace burner.

Other objects will in part be obvious and will in part appear hereinafter.

SUMMARY OF THE INVENTION

In accordance with the foregoing objects, the invention comprises a jacket which encloses the smoke pipe for a predetermined portion of the length thereof which extends through a relatively unheated space between the furnace and chimney. The jacket is preferably cylindrical, a few inches larger in diameter than the smoke pipe, and is substantially sealed at its opposite ends to the exterior of the smoke pipe, forming an annular space or chamber between the smoke pipe and jacket. An intake opening is provided near one end of the jacket to admit air from the relatively unheated space or from a return duct connected to the heated space, into the annular chamber wherein it is directed through baffle means to an outlet opening near the opposite end of the jacket.

Preferably, an air intake fan is located in the intake opening and is driven in conventional fashion by an electric motor, thereby forcing circulation of air through the annular chamber. The switch contacts for the motor are closed and opened automatically in response to like operation of the switch contacts for the furnace burner, operation of which is controlled in the usual manner by a thermostat located in some desired remote location. For maximum efficiency of operation, timer means provide a predetermined delay between turning on and off of the burner and like operation of the fan motor.

The outlet opening of the annular chamber is connected to a duct through which the air heated by the smoke pipe is conducted to a space to be heated thereby. Further baffle means may optionally be provided within the portion of the smoke pipe enclosed by the jacket to retard the flow of combustion products therethrough, thus recovering a greater amount of the available heat. The baffle means within the annular chamber are laterally disposed to retard the flow of air therein as it absorbs heat from the smoke pipe, such baffle means being disclosed in two embodiments.

DETAILED DESCRIPTION

Figure 1:
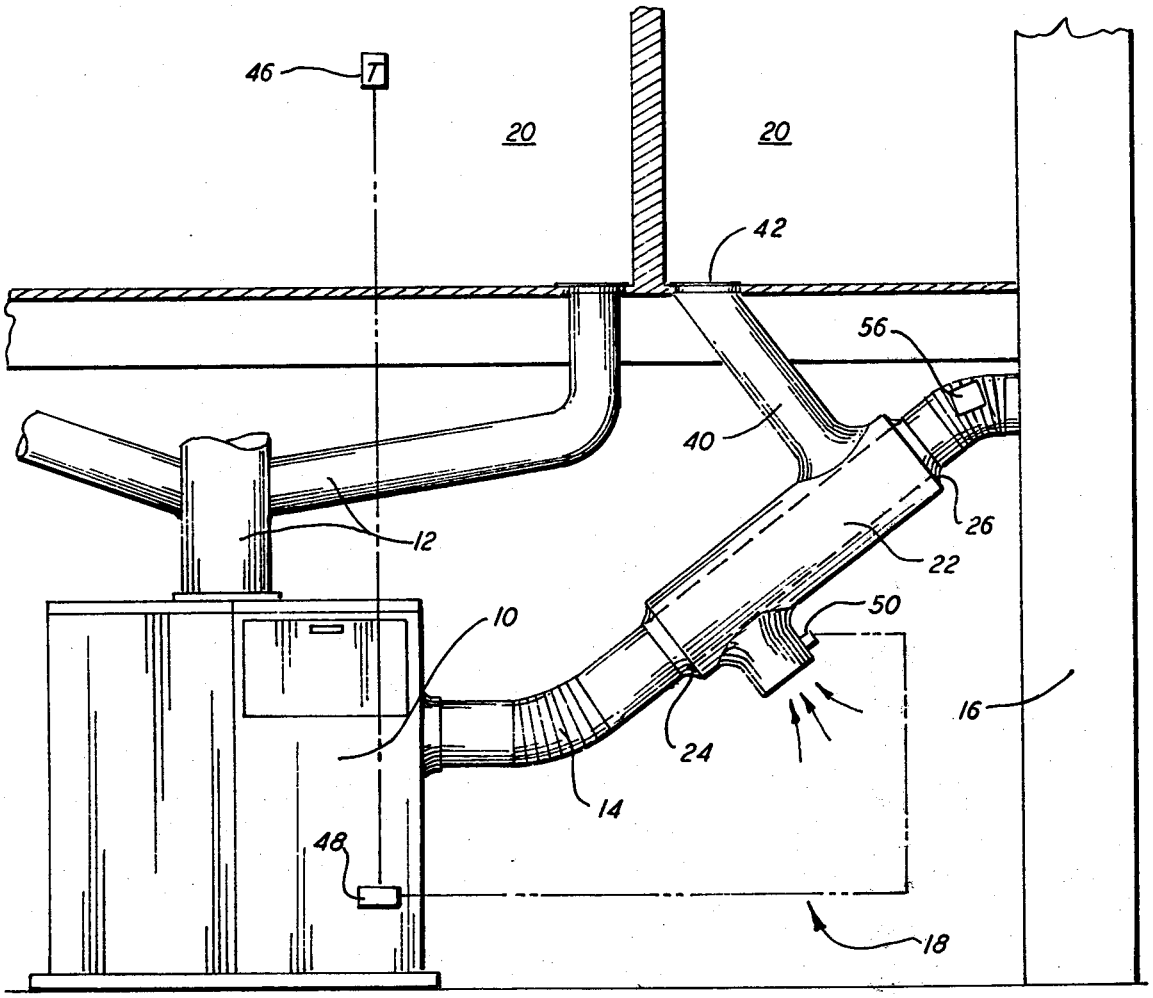
FIG. 1 is an elevational view showing the attachment of the invention incorporated with a conventional domestic heating system.

Referring now to the drawings, in FIG. 1 are shown portions of a typical domestic heating system including furnace 10 wherein a suitable fuel is burned within a combustion chamber to produce heated air for circulation through ductwork, a portion of which is indicated by reference numeral 12, to rooms or other spaces to be heated. Smoke and other products of combustion are vented from the combustion chamber through flue or smoke pipe 14 which in turn is connected to chimney 16 for exhaust to the atmosphere. Furnace 10 and smoke pipe 14, or at least a portion thereof, are located in a spaced generally indicated by reference numeral 18 such as a basement, utility room, garage, or other such location which is relatively unheated as compared to the space indicated by reference numeral 20 which receives the heated air conveyed through ductwork 12. That is, the temperature in space 18 will typically be significantly lower than the temperature in space 20. Furthermore, the temperature in space 18 is not normally of any consequence in the overall operation of the heating system which is primarily designed only to provide the required amount of heat to space 20 and similar spaces to be heated. Thus, most or all of the heat which is conducted through the walls of smoke pipe 14 and radiated therefrom into space 18 is, in most typical situations, lost or wasted. Although the heating system illustrated is of the hot-air type, the invention may be employed with equal advantage in hot water, steam, or other types of heating systems employing a furnace with combustion chamber and smoke pipe located in a relatively unheated space.

The attachment of the present invention is constructed separately from the heating system and may be conveniently installed concurrently with or at any time after installation of the basic heating system. The attachment includes jacket 22 which encloses a portion of smoke pipe 14 for a predetermined portion of its length between ends 24 and 26 of jacket 22. While the length of jacket 22 is not critical, it is preferred that it extend approximately the full length of at least the straight run portion of smoke pipe 14 which will, of course, vary from one installation to another. Likewise, the diameter of jacket 22 is not critical, but should be several inches larger than the diameter of smoke pipe 14. Although a cylindrical configuration, concentric with smoke pipe 14, is preferred, other cross-sectional configurations may be employed.

Figure 2:
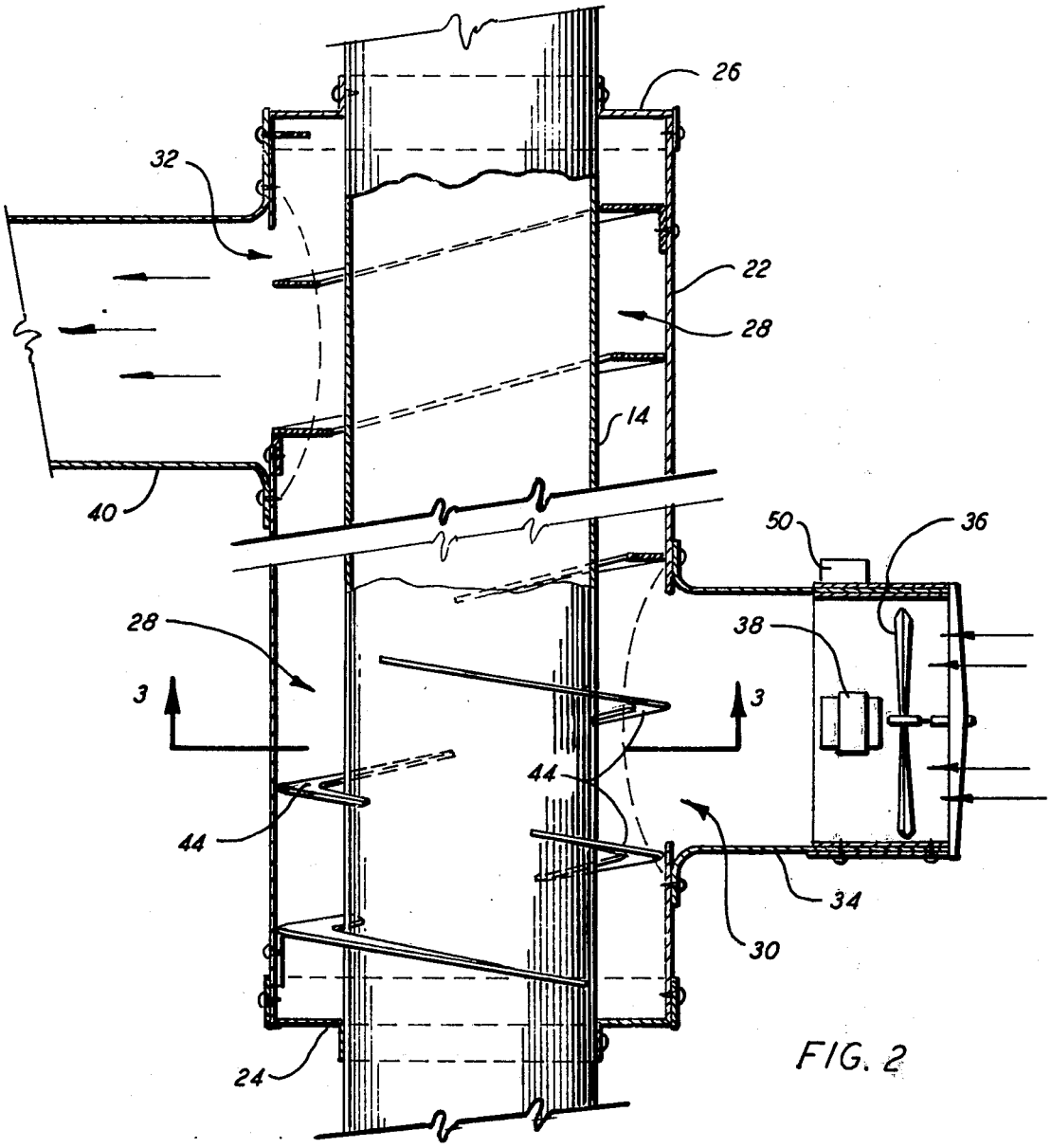
FIG. 2 is a fragmentary, elevational view in axial half section showing the attachment and a portion of the smoke pipe of FIG. 1.

As best seen in FIG. 2, jacket 22 is supported upon smoke pipe 14 at ends 24 and 26, which form closures for the annular chamber, generally indicated by reference numeral 28, formed between the outer walls of smoke pipe 14 and inner walls of jacket 22. Intake opening 30 is provided in the wall of jacket 22 adjacent end 24 and outlet opening 32 is similarly provided adjacent end 26. Opening 30 is surrounded by short (e.g. 8 inch), tubular section 34 within which are supported air intake fan 36 and electric motor 38 which drives the fan blade. Opening 32 is surrounded by duct 40 which extends from its connection with jacket 22 to an outlet end shown in FIG. 1 and denoted by reference numeral 42.

Thus, annular chamber 28 communicates through opening 30 and tubular section 34 with relatively unheated space 18, and through opening 32 and duct 40 with relatively heated space 20. Preferably, end 24 and opening 30 are at a lower elevation than end 26 and opening 32. As air within chamber 28 is heated by radiation and convection due to the elevated temperature of smoke pipe 14 during operation of furnace 10, it will rise and leave chamber 28 through opening 30, being replaced by cooler air drawn in from space 18 through opening 30. The rate of air flow through chamber 28 is increased, of course, by operation of fan 36 and should be properly balanced in accordance with the volume of chamber 28 and typical temperatures of smoke pipe 14 in particular applications to achieve the desired temperature rise in the air as it passes from opening 30 to opening 32.

Figure 3:
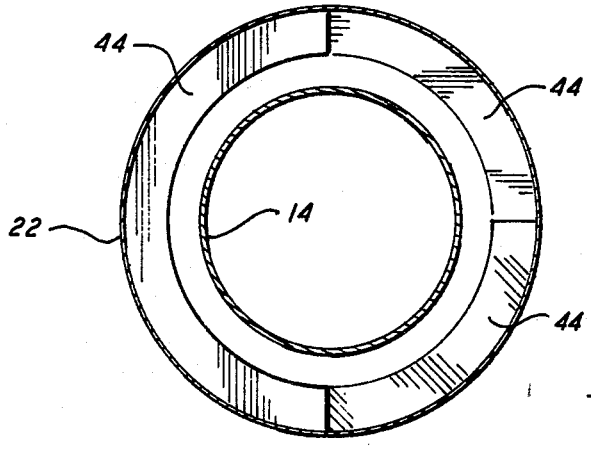
FIG. 3 is a plan view in section on the line 3—3 of FIG. 2.

In order to increase the heat transfer efficiency, baffle means are provided within chamber 28 to retard the flow of air therethrough. In the embodiment illustrated in FIGS. 2 and 3, the baffle means comprises a series of separate baffle plates 44 secured to the inner wall of jacket 22 and extending therefrom laterally across and spirally along chamber 28. Preferably, baffle plates 44 extend only partially across chamber 28, leaving a clearance between the inner edges of plates 44 and the outer wall of smoke pipe 14. While it is possible to construct a single, spiral plate extending substantially between positions adjacent openings 30 and 32, or completely from end 24 to end 26, it is preferred that a plurality of separate plates be provided, as shown. Each of plates 44 extends approximately 180° around the circumference of jacket 22 in a spiral path. Successive plates are spaced by several inches and are preferably staggered by about 90°. That is, successive baffle plates are overlapped by about 90° with respect to the circumferential dimension of jacket 22.

Smoke pipe 14 reaches the elevated temperatures required for effective heat transfer only during periods of operation of furnace 10, i.e., only while fuel is being burned and products of combustion are passing through the smoke pipe. In typical heating systems, operation of the furnace is controlled automatically by means of one or more thermostats located in the spaces to be heated. The temperature-responsive contacts of the thermostat initiate electrical actuation of the furnace burner and sometimes of other components such as blowers, pumps, etc. Referring again to FIG. 1, a thermostat is indicated by reference numeral 46 in space 20 and is wired to control box 48 of furnace 10. Operation of one or more portions of furnace 10 is initiated and terminated in conventional fashion by electrical contacts in box 48 in response to signals controlled by thermostat 46. Control box 48 is also connected, through timer 50, to fan motor 38. Timer 50 establishes a predetermined time delay between initiation of furnace operation and initiation of fan motor operation. Likewise, a time delay may be established between termination of furnace and fan motor operation. Although the delay is preferably adjustable, a delay of about 50 seconds in a typical application will allow the smoke pipe to reach an effectively elevated temperature prior to forced circulation through jacket 22. Similarly, a delay in turning off fan motor 38 for a time after furnace operation is terminated will allow residual heat in smoke pipe 14 to be absorbed by air passing through chamber 28.

Figure 4:
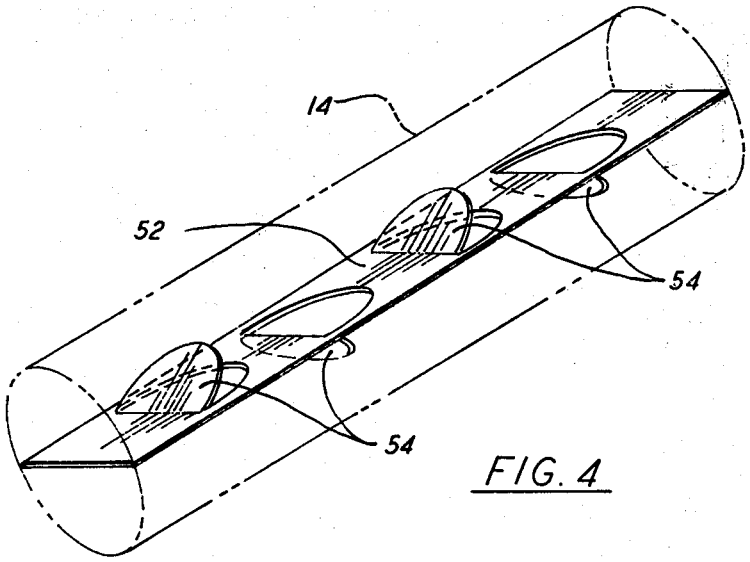
FIG. 4 is a perspective view of further structure which may optionally be incorporated in the smoke pipe of FIGS. 1 and 2.

In FIG. 4 is shown an optical additional baffle means which may be mounted within smoke pipe 14 to retard the rate of flow of combustion products therethrough. The baffle means of FIG. 4 does not replace, but rather supplements the baffle means within chamber 28 formed by plates 44. The baffle means within smoke pipe 14 is formed from a single, flat sheet of metal 52, with semicircular cuts at intervals along its length bent outwardly to form tabs 54. The width of sheet 52 is approximately equal to the diameter of smoke pipe 14 and tabs 54 alternately extend in opposite directions from sheet 52 to provide some degree of flow restriction. In typical installations, baffle means such as that of FIG. 4 will be desirable, if at all, only in smoke pipes of relatively large diameter or where the pipe is essentially vertical in the area where it is surrounded by the jacket of the heat saver attachment. It is also preferable that, when baffle means are employed internally of smoke pipe 14, such as strip 52 having tabs 54 inhibiting flow therethrough, that the diameter of the smoke pipe be somewhat larger (e.g., 1 or 2 inches) than required for normal furnace operation.

In the usual installations, the smoke pipe is provided with a draft or damper control. Although it is not critical, it is preferred that such damper controls be located further from furnace 10 than is jacket 22, as indicated at 56 in FIG. 1, since the products of combustion may be cooled by the air enter ng at the damper. Again, the location of the damper control above the heat saver attachment is especially desirable in installations where the smoke pipe approaches a vertical orientation. Although the smoke pipe may be of galvanized iron, or other conventional materials, heat transfer efficiency of the present invention may be enhanced by constructing at least that portion enclosed by jacket 22 of copper, stainless steel, or a similar material to make maximum use of retained heat. The preferred construction is to make all of the smoke pipe section which is enclosed by the jacket, plus about one or two feet additional on the downstream side of the jacket, of stainless steel to protect against corrosion by moisture which may form due to the temperature differential which results from removal of heat from this portion of the pipe.

Figure 5:
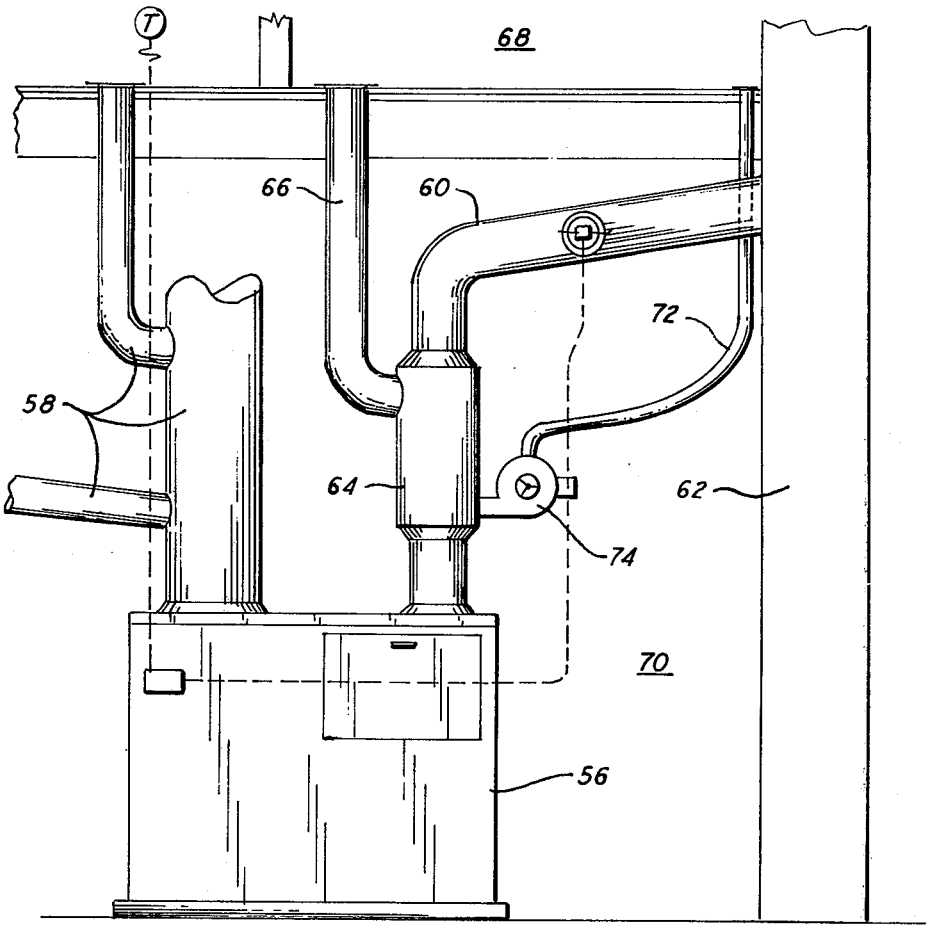
FIG. 5 is a view similar to FIG. 1 showing certain variations in the installation.

In FIG. 5 is shown an installation employing another embodiment of the attachment, which is the preferred construction. Again, the illustrated heating system is of the hot-air type with furnace 56 having a burner providing heated air through ductwork 58 to spaces to be heated and having smoke pipe 60 for venting the products of combustion to chimney 62 and thence to the outside atmosphere. Jacket 64 surrounds smoke pipe 60 for a portion of its length, in this case a vertically disposed section. Although the length of jacket 64 is optional, a length of at last 30 inches is satisfactory for most typical installations.

Duct 66 connects the annular chamber between smoke pipe 60 and jacket 64, at its outlet end, with space 68 to be heated. Although air may be drawn into the annular chamber from relatively unheated space 70, as in the installation of FIG. 1, duct 72 may be provided for return air from space 68. Fan 74 is provided, as in the previous construction, for drawing air into the annular chamber at a desired rate during operation.

Jacket 64 is formed of outer and inner concentric, cylindrical walls of sheet metal 76 and 78, respectively, with insulating material 80 therebetween. The use of insulating material is optional and will normally be governed by the type and location of the installation. The portion of smoke pipe 60 within jacket 64 is of larger diameter, preferably about one inch, than the portion of the smoke pipe outside the jacket. The portion outside the jacket has a diameter equal to that specified for use with the particular furnace installation, the larger diameter portion within jacket 64 being denoted by reference numeral 60'. Transition sections 82 are provided for connecting the different diameter portions 60 and 60' of the smoke pipe at the upper and lower ends of jacket 64. The annular chamber formed between inner wall 78 of jacket 64 and smoke pipe section 60' is denoted by reference numeral 83. Conventional spacers (not shown) of heavy gauge sheet metal may be provided at the top and bottom of jacket 64 to keep the pipe perfectly round and each wall exactly spaced.

Baffle plates 84 and 86 extend laterally across annular chamber 83 at alternating, spaced intervals of, for example, four or five inches, depending on the width of chamber 83. As seen from a comparison of FIGS. 7A and 7B, baffle plates 84 and 86 are both annular, sheet metal plates extending laterally across the full width and around the full periphery of chamber 83. Each includes cut-out portions spaced equally about its periphery, the plates differing in that cut-out areas 88 of plate 84 extend inwardly from the edge adjoining inner wall 78 of jacket 64, while cut-out areas 90 of plate 86 extend inwardly from the edge adjoining smoke pipe section 60'. Plates 84 and 86, and the succeeding plates which alternate in the position of the cut-out areas, may be retained in place within chamber 83 by frictional or press fit between wall 78 and smoke pipe section 60'. Thus, as air travels upwardly within chamber 83 its flow is impeded by plates 84 and 86, and it is caused to flow in an irregular path through alternating cut-out areas 88 and 90, thereby maximizing heat transfer from smoke pipe section 60'.

Figure 7A:
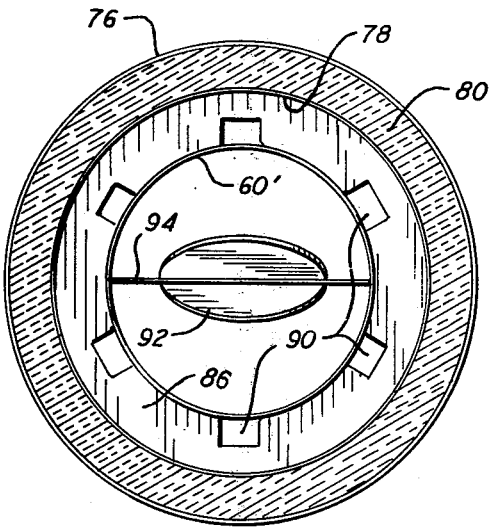
FIGS. 7A and 7B are full plan views in section on the lines 7A—7A and 7B—7B, respectively, of FIG. 6.
Figure 7B:
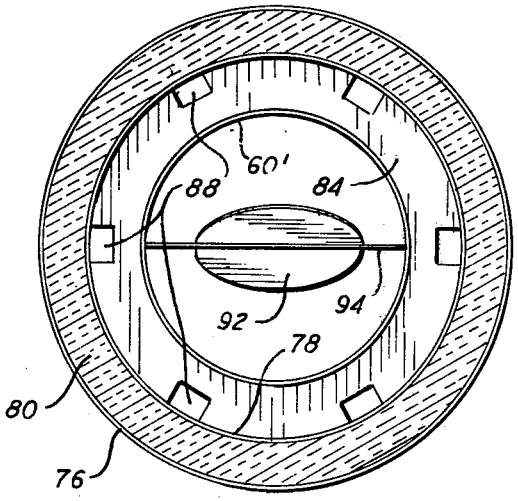
Figure 6:
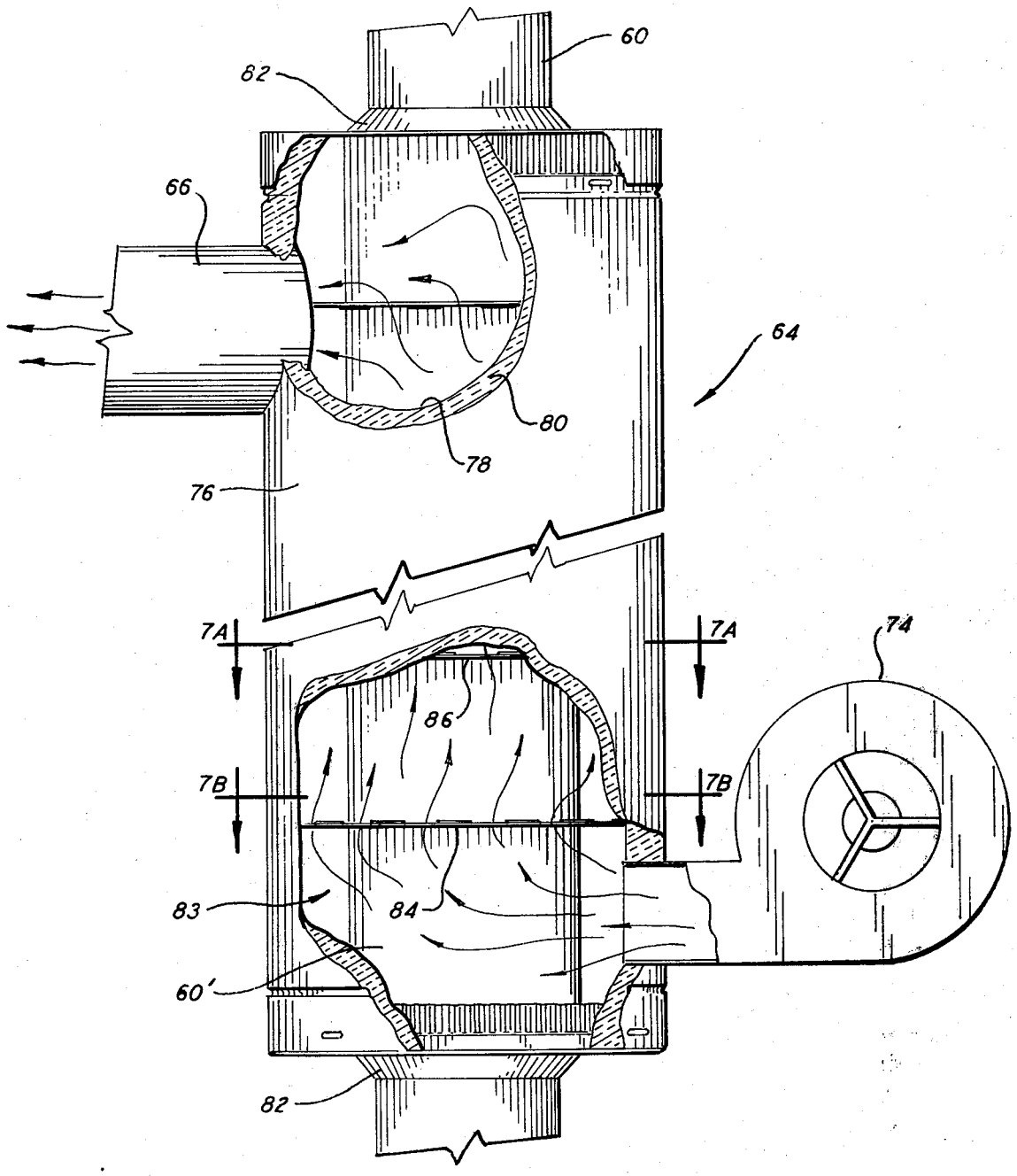
FIG. 6 is an elevational view, with portions broken away, showing a second embodiment of the attachment.

Also seen in FIGS. 7A and 7B is damper plate 92, mounted on shaft 94 for rotating movement between blocking and unblocking positions with respect to the interior of smoke pipe 60, either within or outside section 60' thereof. Movement of damper plate 92 is controlled by a suitable solenoid or similar means (not shown) electrically actuated in response to operation of the furnace. That is, when the furnace burner is actuated damper plate 92 is automatically moved to the open postion to allow free flow of smoke and other combustion products through smoke pipe 60, and when burner is not in operation, the damper plate is automatically moved to a partially blocking position to impede flow of warm air out of the chimney. Humidifiers and other such accessories may also be combined with the attachment and associated warm air duct.

What is claimed is:

1. A heat saving attachment for a central heating system including a furnace located in a relatively unheated space and having a thermostatically controlled burner operable to supply heat to a relatively heated space in response to the temperature in said heated space falling below a preset level, a chimney for venting products of combustion from said burner to the atmosphere, and a cylindrical smoke pipe extending for a given axial distance through said unheated space from said furnace to said chimney, said attachment comprising, in combination:

(a) a cylindrical jacket concentrically surrounding said smoke pipe and extending between first and second ends for an axial distance less than said given distance to provide a first portion of said smoke pipe between said furnace and said jacket, a second portion surrounded by said jacket, and a third portion between said jacket and said chimney, both said smoke pipe and said attachment lying entirely within said unheated space;

(b) said first and third portions of said smoke pipe being of the same diameter and said second portion being of larger diameter;

(c) means substantially sealing said first and second ends of said jacket to the exterior of said smoke pipe, thereby providing an enclosed, annular chamber of substantially constant transverse dimension between the exterior of said smoke pipe and the interior of said jacket;

(d) a duct communicating at one end with said chamber, adjacent one of said sealed ends thereof, and at the other end with said heated space;

(e) an air intake opening through which said chamber communicates, adjacent the other of said sealed ends thereof, with said unheated space;

(f) a plurality of individual, solid plates of the same annular dimensions as said chamber and supported therein at uniformly spaced intervals to lie in planes normal to the axis of the smoke pipe and jacket;

(g) alternate ones of said plates each having a plurality of first openings spaced about the outer periphery and extending inwardly from said jacket for a first portion of the radial dimension of said chamber;

(h) alternate plates intermediate of said ones each having a plurality of second openings spaced about the inner periphery and extending outwardly from said smoke pipe for a second portion of the radial dimension of said chamber, said second openings being axially misaligned with respect to said first openings;

(i) an air circulating fan disposed to force movement of air into said intake opening, through said annular chamber and into said duct;

(j) an electric motor actuable to drive said fan;

(k) switch means movable to actuate and deactuate said motor; and (l) timer means operable to close said switch means for actuation of said motor in response to and a predetermined time delay after actuation of said burner and to open said switch means for deactuation of said motor in response to and a predetermined time delay after deactuation of said burner.

2. The invention according to claim 1 wherein said first and second portions are substantially equal and the sum thereof is not greater than the total radial dimension of said chamber.

3. The invention according to claim 2 wherein said first and second portions are each approximately one-half the total radial dimension of said chamber.

* * * * *